US005667594A

United States Patent [19]

Omure et al.

[11] Patent Number: 5,667,594

[45] Date of Patent: Sep. 16, 1997

[54] CLEANING METHOD WITH SOLVENT

[75] Inventors: Yukio Omure; Hirokazu Aoyama; Satoshi Ide; Takahiro Matsuda, all of Settsu, Japan

[73] Assignee: Daikin Industries Ltd., Osaka, Japan

[21] Appl. No.: 196,214

[22] PCT Filed: Oct. 29, 1992

[86] PCT No.: PCT/JP92/01402

§ 371 Date: Mar. 14, 1994

§ 102(e) Date: Mar. 14, 1994

[87] PCT Pub. No.: WO93/09216

PCT Pub. Date: May 13, 1993

[30] Foreign Application Priority Data

| | | | |
|---|---|---|---|
| Oct. 31, 1991 | [JP] | Japan | 3-314144 |
| Nov. 25, 1991 | [JP] | Japan | 3-335664 |
| Nov. 25, 1991 | [JP] | Japan | 3-335665 |

[51] Int. Cl.[6] ..... B08B 3/00

[52] U.S. Cl. ..... 134/26; 134/12; 134/31; 134/40; 134/42; 510/174; 510/170; 510/175; 510/177; 510/365; 510/407; 510/408; 510/412; 510/415; 510/505; 510/411; 510/364; 252/364

[58] Field of Search ..... 252/542, 153, 252/170, 171, DIG. 9, 364; 134/12, 31, 40, 26, 42; 510/174, 170, 175, 177, 365, 407, 408, 412, 415, 505

[56] References Cited

U.S. PATENT DOCUMENTS

| | | | |
|---|---|---|---|
| 3,794,524 | 2/1974 | Nogueira | 252/171 |
| 4,276,186 | 6/1981 | Bakos et al. | 252/158 |
| 4,559,154 | 12/1985 | Powell | 252/69 |
| 5,064,559 | 11/1991 | Merchant et al. | 252/364 X |
| 5,073,291 | 12/1991 | Robeck et al. | 252/364 X |
| 5,219,488 | 6/1993 | Basu et al. | 252/171 |
| 5,219,489 | 6/1993 | Swan et al. | 252/171 |
| 5,221,361 | 6/1993 | Anton et al. | 252/162 |
| 5,221,493 | 6/1993 | Merchant et al. | 252/67 |
| 5,250,208 | 10/1993 | Merchant et al. | 252/364 X |
| 5,268,122 | 12/1993 | Rao et al. | 252/171 |
| 5,288,335 | 2/1994 | Stevens | 134/38 |
| 5,294,358 | 3/1994 | Dantinne et al. | 252/67 |
| 5,304,253 | 4/1994 | Grant | 134/26 |
| 5,346,645 | 9/1994 | Omure et al. | 252/364 X |
| 5,424,002 | 6/1995 | Omure et al. | 252/171 |
| 5,454,969 | 10/1995 | Fields et al. | 252/162 |
| 5,531,916 | 7/1996 | Merchant | 510/412 |

FOREIGN PATENT DOCUMENTS

| | | |
|---|---|---|
| 431458 | 6/1991 | European Pat. Off. . |
| 47-32007 | 11/1972 | Japan . |
| 1-139540 | 6/1989 | Japan . |
| 1-304194 | 12/1989 | Japan . |
| 1-319595 | 12/1989 | Japan . |
| 90/08814 | 8/1990 | WIPO . |

OTHER PUBLICATIONS

Chemical Abstract 68:73860a, abstract of Kocharyan et al, *Izv. Akad. Nauk SSSR, Ser. Khim.*, 1967(6) pp. 1392–1394.

Kocharyan, S. T., et al., "Nuclear magnetic resonance spectra of 2–monohydroperfluoroisobutane–triethylamine mixtures", Izv. Akad. Nauk. SSSR, Ser. Khim., (6), 1342–4 1967 (Month unknown).

*Primary Examiner*—Douglas J. McGinty

*Attorney, Agent, or Firm*—Armstrong, Westerman, Hattori, McLeland & Naughton

[57] ABSTRACT

A cleaning solvent composition that is made by either blending aliphatic fluorohydrocarbon as expressed by the general formula $$C_nF_mH_{2n+2-m}$$

(wherein, n and m are a positive integral numbers, being $4 \leqq n \leqq 6$, $2n-3 \leqq m < 2n+2$ respectively) or blending a mixture of this aliphatic fluorohydrocarbon and alcohol having a carbon number of 1 to 4 with lactam and/or carboxylic acid amide, tertiary amines, or alcohol having ether linkage and/or amino linkage within its molecules. A cleaning process wherein an object is dipped into the said composition to remove dirty component, then rinsed with a mixture of the said aliphatic fluorohydrocarbon and the said alcohol having a carbon number of 1 to 4, and thereafter the object is steam cleaned with the said mixture when necessity arises. The use of the cleaning solvent composition, which does not destroy the ozone, is non-combustible, and shows an excellent cleaning effect, enables the object to be rinsed and steam cleaned in a nonaqueous system and allows the subsequent drying process to be simplified, and thus leads to a cleaned object free of residue and stains.

1 Claim, No Drawings

CLEANING METHOD WITH SOLVENT

INDUSTRIAL FIELD

This invention relates to a cleaning solvent composition and a cleaning process in which flux, oil, mold-releasing agents, printing ink and the like adhered to an object are removed there-from to clean the object using the said cleaning solvent composition.

PRIOR ART

In the prior art, flon 113, a chlorofluoroethane compound, has several advantages including (a) non-combustibility, (b) low biotoxicity and (c) highly selective solubility (able to dissolve fat and oil, grease and wax etc. without damaging plastics, rubber and other high molecular materials), and it has been widely used either by itself, in a mixture with other organic solvents, or in the form of azeotropic compositions as a solvent or cleaning agent. However, it has been feared that flon may destroy the ozone layer in the stratosphere and thereby cause serious adverse effects on the earth's ecosystem including the environment for humans. According to an international agreement it has been concluded to limit the use and production of flon which threatens the ozone layer with destruction. Accordingly, people very much want the development of a solvent or cleaning agent that uses flon substitutes.

Patent Publication Gazette No. 21000/83 discloses a cleaning composition that contains at least 50% by weight of N-methyl-2-pyrrolidone and at least 10% by weight of alkanol amine that can mix with water. Lines 27 to 35 of the sixth column of the cited reference mention that the cleaning composition can be used with a hydrocarbon solvent consisting of Freon such as fluorohydrocarbon and tetrafluoroethane up to about 35%. This composition, however, requires a rinsing process using water (for removal of composition adhered to the surface of the cleaned object) to be followed by a complicated drying process.

OBJECTIVE OF INVENTION

The object of the present invention is to provide a novel cleaning solvent composition that is useful for flon substitute technology and effective as a cleaning agent. The present invention is also intended to provide a nonaqueous cleaning process with no use of water which uses the said solvent composition to efficiently remove flux, oil, mold-releasing agents, printing ink and other residue adhered to an object to be cleaned.

CONSTRUCTION OF INVENTION

The present invention relates to a cleaning solvent composition that is made by either blending aliphatic fluorohydrocarbon as expressed by the general formula $$C_nF_mH_{2n+2-m}$$

(wherein, n and m are positive integral numbers, being $4 \leqq n \leqq 6$ and $2n-3 \leqq m < 2n+2$, respectively) or blending a mixture of the said aliphatic fluorohydrocarbon and alcohol having a carbon number of 1 to 4 with at least one selected from a group comprising lactam and/or carboxylic acid amide, tertiary amines, and alcohol having ether linkage and/or amino linkage within its molecules.

The present invention also provides a cleaning process in which an object to be cleaned is dipped into the said cleaning solvent composition for removal of residue or dirty component and thereafter it is rinsed with a rinsing agent composition that is a mixture of the said aliphatic fluorohydrocarbon and the said alcohol having a carbon number 1 to 4, and it is further steam cleaned with the said mixture composition when necessary, The said cleaning solvent under the present invention is desirably be a blend of either the said aliphatic fluorohydrocarbon or the said mixture with lactam and/or carboxylic acid amide at a blending proportion preferably of 10 to 95% by weight, or more desirably 10 to 50% by weight. The higher content of lactam and/or carboxylic acid amide often exhibits a high ability to remove residue although, in some cases, due to the resistance property of the material of the object to be cleaned, cleanable objects are limited. The lower content, on the other hand, shows a highly selective solubility (ability to dissolve and remove residue without adverse effects on the material of the cleanable object).

In view of the above-mentioned properties, it is desirable to set the blending ratio of the lactam and/or carboxylic acid amide preferably somewhere in the range mentioned above.

If the said tertiary amines or alcohol which has ether linkage and/or amino linkage within its molecules are to be substituted for the said lactam and/or carboxylic acid amide, the said aliphatic fluorohydrocarbon or the said mixture under the present invention is desirably blended with the said tertiary amine or the said alcohol at a blending proportion of at least 10% by weight, more desirably 10 to 95% by weight, and further more desirably 10 to 50% by weight. In this case the higher content of the said tertiary amines and the said alcohol exhibits a high ability to remove residue although, in some cases, due to the resistance property of the material of the object to be cleaned, cleanable objects are limited. The lower content, on the other hand, gives a highly selective solubility (ability to dissolve and remove residue without adverse effects on the materials of the cleanable object).

In view of the above-mentioned properties, it is desirable to set the blending ratio of the tertiary amines or alcohol which has ether linkage and/or amino linkage within its molecules preferably somewhere in the range mentioned above. This preferred range is also applied to the combined use of at least two of the said three kinds of compounds.

The said mixture-based rinsing agent composition used for the said rinsing and vapor cleaning processes is preferably of an azeotropic or an azeotrope-like composition. More specifically, if the composition is azeotropic or azeotrope-like, it has a certain rinsing effect, and therefore, it not only assures a steady cleaning quality but also provides ease in handling owing to the invariability of its composition when recovered.

In the cleaning method of the present invention, the said rinsing process may be carried out by at least one application of dip cleaning, ultrasonic cleaning, and spray cleaning.

The aliphatic fluorohydrocarbon used under the present invention is preferably be in a liquid state at normal temperature as exemplified by compounds expressed by the following formula: $C_4F_6H_4$; $C_4F_7H_3$; $C_4F_8H_2$; $C_4F_9H$; $C_5F_7H_5$; $C_5F_9H_4$; $C_5F_9H_3$; $C_5F_{10}H_2$; $C_5F_{11}H$; $C_6F_9H_5$; $C_6F_{10}H_4$; $C_6F_{11}H_3$; $C_6F_{12}H_2$; $C_6F_{13}H$.

Specific preferred examples of the said aliphatic fluorohydrocarbon include 1, 1, 2, 3, 4, 4-hexafluorobutane ($HCF_2CFHCFHCF_2H$);

1, 1, 1, 2, 3, 3, 4-heptafluorobutane ($CF_3CFHCF_2CH_2F$);

1, 1, 1, 2, 2, 3, 3, 4-octafluorobutane ($CF_3CF_2CF_2CH_2F$);

1, 4-dihydro-1, 1, 2, 2, 3, 3, 4, 4-octafluorobutane ($H(CF_2CF_2)_2H$);

1, 1, 1, 2, 2, 3, 4, 4, 4-nonafluorobutane ($CF_3CF_2CFHCF_3$);

1, 1, 2, 2, 3, 3, 4-heptafluoropentane ($HCF_2(CF_2)_2CFHCH_3$);
1, 1, 2, 3, 3, 4, 5, 5-octafluoropentane ($HCF_2CFHCF_2CFHCF_2H$);
1, 1, 1, 2, 2, 5, 5, 5-octafluoropentane ($CF_3CH_2CH_2CF_2CF_3$);
1, 1, 1, 2, 3, 3, 4, 4, 5-nonafluoropentane ($CF_3CFHCF_2CF_2CH_2F$);
1, 1, 2, 2, 3, 3, 4, 4, 5-nonafluoropentane ($HCF_2(CF_2)_3CH_2F$);
1, 1, 1, 2, 2, 3, 5, 5, 5-nonafluoropentane ($CF_3CH_2CFHCF_2CF_3$);
1, 1, 1, 2, 2, 4, 5, 5, 5-nonafluoropentane ($CF_3CFHCH_2CF_2CF_3$);
2-trifluoromethyl-1, 1, 1, 2, 4, 4-hexafluorobutane ($(CF_3)_2CFCH_2CF_2H$);
1, 1, 1, 2, 2, 4, 4, 5, 5, 5-decafluoropentane ($CF_3CF_2CH_2CF_2CF_3$);
1, 1, 1, 2, 2, 3, 4, 5, 5, 5-decafluoropentane ($CF_3CFHCFHCF_2CF_3$);
1, 1, 1, 2, 2, 3, 3, 4, 5, 5-decafluoropentane ($CF_3CF_2CF_2CFHCF_2H$);
2-trifluoromethyl-1, 1, 1, 2, 4, 4, 4-heptafluorobutane ($(CF_3)_2CFCH_2CF_3$);
1, 1, 1, 2, 2, 3, 3, 4, 5, 5, 5-undecafluoropentane ($CF_3CF_2CF_2CFHCF_3$);
1, 1, 1, 2, 2, 3, 3, 4, 4, 5, 5-undecafluoropentane ($CF_3CF_2CF_2CF_2CF_2H$);
2-trifluoromethyl-1, 1, 1, 2, 3, 3, 4, 4-octafluorobutane ($(CF_3)_2CFCF_2CF_2H$);
1, 1, 1, 2, 2, 3, 3, 4, 4-nonafluorohexane ($CF_3(CF_2)_3CH_2CH_3$);
1, 1, 1, 2, 2, 5, 5, 6, 6, 6-decafluorohexane ($CF_3CF_2CH_2CH_2CF_2CF_3$);
2-trifluoromethyl-1, 1, 1, 2, 3, 4, 5-heptafluoropentane ($(CF_3)_2CFCFHCFHCFH_2$);
2-trifluoromethyl-1, 1, 1, 3, 4, 5, 5, 5-octafluoropentane ($(CF_3)_2CHCFHCFHCF_3$);
2-trifluoromethyl-1, 1, 1, 2, 3, 4, 5, 5-octafluoropentane ($(CF_3)_2CFCFHCFHCF_2H$);
2-trifluoromethyl-1, 1, 1, 2, 3, 5, 5, 5-octafluoropentane ($(CF_3)_2CFCFHCH_2CF_3$);
1, 1, 2, 2, 3, 3, 4, 4, 5, 5, 6, 6-dodecafluorohexane ($HCF_2(CF_2)_4CF_2H$);
2-trifluoromethyl-1, 1, 1, 3, 4, 4, 5, 5, 5-nonafluoropentane ($(CF_3)_2CHCFHCF_2CF_3$);
2-trifluoromethyl-1, 1, 1, 2, 3, 4, 5, 5, 5-nonafluoropentane ($(CF_3)_2CFCFHCFHCF_3$);
1, 1, 1, 2, 2, 3, 3, 4, 4, 5, 6, 6, 6-tridecafluorohexane ($CF_3CF_2CF_2CF_2CFHCF_3$);
1, 1, 1, 2, 2, 3, 3, 4, 4, 5, 5, 6, 6-tridecafluorohexane ($CF_3CF_2CF_2CF_2CF_2CF_2H$);
2-trifluoromethyl-1, 1, 1, 3, 4, 4, 4-heptafluorobutane ($(CF_3)_2CHCFHCF_3$);
2-trifluoromethyl-1, 1, 1, 3, 3, 4, 4, 4-octafluorobutane ($(CF_3)_2CHCF_2CF_3$);
1, 1, 1, 2, 3, 3, 5, 5 5-nonafluoropentane ($CF_3CFHCF_2CH_2CF_3$);
1, 1, 1, 2, 2, 4, 4, 5, 5-nonafluoropentane ($HCF_2CF_2CH_2CF_2CF_3$);
2-trifluoromethyl-1, 1, 1, 2, 4, 4, 5, 5, 5-nonafluoropentane ($(CF_3)_2CFCH_2CF_2CF_3$);
2-trifluoromethyl-1, 1, 1, 3, 4, 4, 5, 5, 5-nonafluoropentane ($(CF_3)_2CHCFHCF_2CF_3$);
2-trifluoromethyl-1, 1, 1, 2, 3, 4, 5, 5, 5-nonafluoropentane ($(CF_3)_2CFCFHCFHCF_3$);
1, 6-dihydro-1, 1, 2, 2, 3, 3, 4, 4-octafluorobutane ($HCF_2CF_2CF_2CF_2H$);
2-trifluoromethyl-1, 1, 1, 3, 4, 5, 5-heptafluoropentane ($(CF_3)_2CHCFHCFHCF_2H$);
1, 6-dihydro-1, 1, 2, 2, 3, 3, 4, 4, 5, 5, 6, 6-dodecafluorohexane ($HCF_2(CF_2CF_2)_2CF_2H$).

Each of these compounds may be used either alone or mixed with at least one of the other compounds.

Examples of alcohol with a carbon number of 1 to 4 which can be used by mixing it with the above-mentioned aliphatic fluorohydrocarbon include methanol, ethanol, isopropanol, n-propanol, isobutanol, sec-butanol, and tert-butanol. Among these alcohols preferred are methanol, ethanol, isopropanol, and n-propanol.

A desired blending proportion of alcohol having a carbon number of 1 to 4 with aliphatic fluorohydrocarbon is in the range of 1 to 30% by weight and more desirably in the range of 2 to 20% by weight. A further more desirable proportion is such that the said alcohol forms an azeotropic or azeotrope-like composition (not an azeotropic composition but virtually similar to an azeotropic composition that has a constant boiling point and an invariable composition).

In the cleaning process under the present invention, a rinsing and vapor cleaning process following the virtual dissolution and removal of residue in a cleaning solvent composition containing lactam and/or carboxylic acid amide, tertiary amines, or alcohols which have ether linkage and/or amino linkage within its molecules requires the use of a composition comprising a mixture of aliphatic fluorohydrocarbon and alcohol with a carbon number of 1 to 4. If the content of alcohol with a carbon number of 1 to 4 is zero or less than 1% by weight, it means that the said rinsing and steam cleaning process are carried out virtually with aliphatic fluorohydrocarbon alone. The result is that residue dissolved and remaining in the said cleaning solvent composition deposits on the surface of the object to be cleaned after the object comes out of the residue removal process, and therefore, a cleaning effect for purification is not obtained.

When the alcohol content of the alcohol mixture used for the said rinsing process exceeds 30% by weight, it will have no particular influence on the resulting rinsing effect. However, it will raise the vapour partial pressure of combustible alcohol, thereby making the mixture easily inflammable in spray or vapor cleaning.

Lactam compounds to be blended with aliphatic fluorohydrocarbon include N-methyl pyrrolidone; N-ethyl pyrrolidone; 3-methyl-2-pyrrolidinone; 5-methyl-2-pyrrolidinone, etc. Carboxylic acid amide compounds include N, N-dimethylformamide; N, N-dimethyl acetamide; formamide; acetamide; etc.

Tertiary amines to be blended with aliphatic fluorohydrocarbon include triethylamine; tributyl amine; N, N-dimethylcyclohexylamine; N, N, N', N'-tetramethyl ethylene diamine; N, N, N', N'-tetramethyl propane-1, 3-diamine; N, N, N', N'-tetramethyl hexane-1, 6-diamine; N, N, N', N'', N''-pentamethyl diethylene triamine; triethylene diamine; N, N'-dimethyl piperazine; N-methyl morpholine; N-ethyl morpholine; 4-(2-dimethylaminoethyl) morpholine; 1, 2-dimethylimidazole; bis (2-dimethylaminoethyl) ether; ethylene glycol bis (3-dimethyl)-aminopropyl ether; pyridine; N-methyl piperidine; beta-picoline; N-methyl pyrrole; etc.

Furthermore, alcohols with ether linkage and/or amino linkage within its molecules which is intended for blending with aliphatic fluorohydrocarbon include furfuryl alcohol; tetrahydro furfuryl alcohol; diethylene glycol; triethylene glycol; dipropylene glycol; ethylene glycol monomethyl ether; ethylene glycol monoethyl ether; ethylene glycol monobutyl ether; ethylene glycol monophenyl ether; ethylene glycol monobenzyl ether; ethylene glycol monoethyl hexyl ether; 2-dimethyl-amino ethanol; 2-(2-dimethylaminoethyl) methyl-amino ethanol; 3-dimethylamino-1-propanol; 1-dimethylamino-2-propanol; etc.

Cleaning an object to purify with the cleaning solvent composition and rinsing agent composition under the present invention is performed by the procedures wherein the object is contacted with a cleaning solvent composition which has either aliphatic fluorohydrocarbon or a mixture of aliphatic fluorohydrocarbon and alcohol having a carbon number of 1 to 4, mixed with lactam and/or carboxylic acid amide, tertiary amines, or alcohol that has ether linkage and/or amino linkage within its molecules to dissolve residue deposited on the object, thereafter, it is contacted with a mixture of aliphatic fluorohydrocarbon and alcohol having a carbon number of 1 to 4 to rinse; and further, the object is steam cleaned with the same mixture to complete cleaning and drying.

In the cleaning process under the present invention, cleaning of an object with the cleaning solvent composition and rinsing thereof with the rinsing agent composition are usually carried out at a normal temperature. These processes, however, may be carried out at a temperature lower than the boiling point when necessary.

It is also useful to add hydrocarbons, stabilizers, surface-active agents, etc. to the cleaning solvent composition under the present invention according to intended purposes.

Hydrocarbons for addition include hexane, 2-methylpentane, 3-methylpentane, heptane, octane, isooctane, cyclopentane, methyl cyclopentane, cyclohexane, methyl cyclohexane, toluene, xylene, etc. The addition of these improves the ability to degrease and so on.

The cleaning solvent composition of the present invention is very stable. Nevertheless, stabilizers may be added to it when necessary. Stabilizers for addition are preferably those that are either entrained and removed by distillation or form an azeotrope. In particular, their addition to cleaning agents used for rinsing and vapor cleaning is preferred.

Specific examples of these stabilizers include nitro compounds such as nitromethane; nitroethane; nitropropane, nitrobenzene, nitrostyrene, etc.; acetylene alcohols such as 3-methyl-1-butyne-3-ol, 3-methyl-1-pentyne-3-ol, etc.; epoxides such as glycidol, methylglycidylether, allylglycidylether, phenyl glycidyl ether, 1, 2-butylene oxide, cyclohexene oxide, epichlorohydrin, etc; ethers such as dimethoxy methane, 1, 2-dimethoxy ethane, 1, 4-dioxane, 1, 3, 5-trioxane, etc.; unsaturated hydrocarbons such as hexene, heptene, octene, 2, 4, 4-trimethyl-1-pentene, pentadiene, octadiene, cyclohexene, cyclopentene, etc.; olefinic alcohols such as allyl alcohol, 1-butene-3-ol; 3-methyl-1-butene-3-ol, etc.; and acrylates such as methyl acrylate, ethyl acrylate, butyl acrylate, vinyl methacrylate, etc. Each of these may be used either alone or with at least one of the other ones.

Futhermore, combined use of the said stabilizers with the stabilizers listed below will produce synergism to heighten the resultant stabilizing effect. Stabilizers for such combined use include phenols such as phenol, trimethyl phenol, thymol, 2, 6-di-t-butyl-4-methyl phenol, butylhydroxyanisol, isoeugenol, etc.; amines such as dipropyl amine, diisopropyl amine, diisobutyl amine, 2, 2, 6, 6-tetramethyl piperidine, N, N'-diallyl-p-phenylene diamine, etc.; and triazoles such as benzotriazole, 2-(2'-hydroxy-5'-methylphenyl) benzotriazole, chlorobenzotriazole, etc.

The quantity of use of stabilizers varies with the types of stabilizers involved. The quantity is preferably of a level that does not adversely affect azeotropy. A desired quantity to be used is normally in the range of 0.1 to 10%, or more desirably in the range of 0.5 to 5%, of the weight of the involved cleaning solvent composition and rinsing agent composition of the present invention. If nitromethane is used, the quantity to be used is preferably in the range of 0.1 to 1%.

Moreover, in order to improve the cleaning effect, interfacial interactivity and the like of the cleaning solvent composition of the present invention, a variety of surface-active agents may be added to the said composition according to necessity. Such surface-active agents include sorbitan fatty acid esters such as sorbitan monooleate, sorbitan trioleate, etc.; polyoxyethylene sorbit fatty acid esters such as polyoxyethylene sorbit tetraoleate, etc.; polyethylene glycol fatty acid esters such as polyoxyethylene monolaurate, etc.; polyoxyethylene alkyl ethers such as polyoxyethylene lauryl ether, polyoxyethylene oleyl ether, etc.; polyoxyethylene polyoxypropylene alkyl ethers such as polyoxyethylene polyoxypropylene cetyl ether, etc.; polyoxyethylene alkyl phenyl ethers such as polyoxyethylene nonyl phenyl ether; and polyoxyethylene alkyl amine fatty acid amides such as polyoxyethylene oleyl amine, polyoxyethylene oleic acid amide, etc. Each of these nonionic surface-active agents may be used either alone or in combination with at least one of the other ones. These nonionic surface active agents may also be used in combination with cationic surface active agents or anionic surface active agents. Cationic and anionic surface-active agents are hard to dissolve in the cleaning solvent composition of the present invention. However, if used together with nonionic surface active agents, they show improved solubility and synergistically heighten the detergency and interfacial interaction.

The quantity of surface-active agents to be used varies with the types of agents involved. The desired quantity to be used is normally in the range of 0.1 to 20%, or more desirably in the range of 0.3 to 5%, of the weight of the involved cleaning solvent composition of the present invention.

INDUSTRIAL APPLICATION

The said cleaning solvent composition of the present invention is not destructive to the ozone and is non-combustible. In addition, it produces an excellent cleaning effect due to the presence of lactam and/or carboxylic acid amides, tertiary amines, or alcohol having ether linkage and/or amino linkage within its molecules. Because rinsing (mainly to rinse away residue dissolved in the solvent composition or lactam, etc.) and steam cleaning (mainly to wash away any few residues remaining after the rinsing process and to dry) in a nonaqueous system are carried out after residue is removed by using the cleaning solvent composition, the drying process can be simplified and the cleaned object free of stains and residue can be obtained.

EMBODIMENTS

Embodiments of the present invention will be described in more detail hereinafter.

Flux Removal Ability

A flux washability test was conducted according to the following procedures: rosin flux (F-AL-1, produced by Tamura Corp.) was applied to a printed circuit board having a size of 10 cm×10 cm; the board was then preheated at 110 deg. C. and soldered at 250 deg. C. for 5 seconds; thereafter, it was dipped into a cleaning solvent composition (1 lit.) (approx. 25 deg. C.) as listed in Tables 1A through 1G to be subjected to dip cleaning for one minute and was then ultrasonically cleaned in an alcohol-mixture-based rinsing agent composition (approx. 35 deg. C.) as shown in Tables 2A and 2B for one minute; and further, it was vapor cleaned with vapor cleaning compositions as listed in Tables 3A and 3B for one minute at each boiling point.

After this cleaning process, the printed circuit board was visually inspected and then measured for ionic residue with an Omegameter 600 SMD (manufactured by Alphametal Co.) to evaluate cleanliness.

Cleaning agents covered by the evaluation are listed in Tables 1A through 1G, 2A and 2B, and 3A and 3B, with the results of evaluation shown in Tables 4A through 4F. In these tables, the blending ratios of respective compounds are shown after the names of each compound in terms of weight ratios.

Degreasing Ability

A degreasing cleaning test was conducted according to the following procedures: a cylindrical 100-mesh wire net (15 mm dia.×20 mm high) with spindle oil deposited thereon was dipped into the cleaning solvent compositions (300 mil. lit.) (approx. 25 deg. C.) as shown in Tables 1A through 1G to undergo dip cleaning for one minute; thereafter, it was ultrasonically cleaned in an alcohol-mixture rinsing agent composition for one minute; and further, it was vapor cleaned with a composition intended for vapor cleaning which comprised the said rinsing agent at each boiling point for one minute.

Subsequently, the wire net was measured for residual oil with an oil densitometer (manufactured by Horiba, Ltd.). The results obtained as the degreasing ratio are shown in Tables 4A through 4F in which rankings of A, B, or C are based on the degreasing ratio in accordance with the following criteria.

Degreasing Ratio 99.6% or higher: A

95% to 99.5%: B

Less than 95%: C

TABLE 1A

| | Cleaning Solvent Composition |
|---|---|
| Example 1 | $[(CF_3)_2CFCH_2CF_2H$/methanol (93.3/6.7)] /[N-methylpyrrolidone] = 80/20 |
| Example 2 | $[(CF_3)_2CFCH_2CF_2H$/ethanol (95.4/4.6)] /[N-methylpyrrolidone] = 80/20 |
| Example 3 | $[(CF_3)_2CFCH_2CF_2H$/isopropanol (95.8/4.2)] /[N-methylpyrrolidone] = 80/20 |
| Example 4 | $[H(CF_2CF_2)_2H$/methanol (96.3/3.7)] /[N-methylpyrrolidone] = 80/20 |
| Example 5 | $[H(CF_2CF_2)_2H$/ethanol (98.9/1.1)] /[N-methylpyrrolidone] = 80/20 |
| Example 6 | $[(CF_3)_2CFCF_2CF_2H$/methanol (96.7/3.3)] /[N-ethylpyrrolidone] = 80/20 |
| Example 7 | $[(CF_3)_2CFCF_2CF_2H$/ethanol (97.9/2.1)] /[N-ethylpyrrolidone] = 80/20 |
| Example 8 | $[CF_3CF_2CH_2CF_2CF_3$/methanol (95/5)] /[5-methyl-2-pyrrolidinone] = 90/10 |
| Example 9 | $[CF_3CF_2CH_2CF_2CF_3$/ethanol (96.5/3.5)] /[5-methyl-2-pyrrolidinone] = 90/10 |
| Example 10 | $[CF_3CF_2CH_2CF_2CF_3$/isopropanol (97/3)] /[5-methyl-2-pyrrolidinone] = 90/10 |
| Example 11 | $[CF_3CFHCFHCF_2CF_3$/methanol (92.5/7.5)] /[N, N-dimethylformamide] = 70/30 |
| Example 12 | $[CF_3CFHCFHCF_2CF_3$/ethanol (94.5/5.5)] /[N, N-dimethylformamide] = 70/30 |
| Example 13 | $[CF_3CFHCFHCF_2CF_3$/isopropanol (95.5/4.5)] /[N, N-dimethylformamide] = 70/30 |
| Example 14 | $(CF_3CF_2CF_2CH_2F$/methanol (95/5)] /[N-methylpyrrolidone] = 85/15 |
| Example 15 | $[HCF_2(CF_2)_3CH_2F$/ethanol (95/5)] /[N-methylpyrrolidone] = 85/15 |

TABLE 1B

| | Cleaning Solvent Composition |
|---|---|
| Example 16 | $[CF_3CF_2CF_2CFHCF_2H$/isopropanol (95/5)] /[N-methylpyrrolidone] = 85/15 |
| Example 17 | $[HCF_2CFHCF_2CFHCF_2H$/tert-butanol (95/5)] /[N-methylpyrrolidone] = 85/15 |
| Example 18 | $[(CF_3)_2CFCF_2CF_2H$/ethanol (95/5)] /[N-methylpyrrolidone] = 85/15 |
| Example 19 | $[CF_3(CF_2)_3CH_2CH_3$/n-propanol (90/10)] /[N-methylpyrrolidone] = 85/15 |
| Example 20 | $[(CF_3)_2CHCFHCF_2CF_3$/isopropanol (90/10)] /[N, N-dimethyl acetamide] = 80/20 |
| Example 21 | $[HCF_2(CF_2)_4CF_2H$/n-propanol (90/10)] /[N, N-dimethyl acetamide] = 80/20 |
| Example 22 | $[(CF_3)_2CFCFHCFHCF_3$/sec-butanol (90/10)] /[N, N-dimethyl acetamide] = 80/20 |
| Example 23 | $(CF_3)_2CFCH_2CF_2H$/N-methylpyrrolidone (80/20) |
| Example 24 | $H(CF_2CF_2)_2H$/N-methylpyrrolidone (80/20) |
| Example 25 | $(CF_3)_2CFCF_2CF_2H$/N-methylpyrrolidone (80/20) |
| Example 26 | $CF_3CF_2CH_2CF_2CF_3$/N-methylpyrrolidone (90/10) |
| Example 27 | $CF_3CFHCFHCF_2CF_3$/N-methylpyrrolidone (70/30) |
| Example 28 | $[(CF_3)_2CFCH_2CF_2H$/methanol (93.3/6.7)] /[N-methylpyrrolidone] = 80/20 |
| Example 29 | $[H(CF_2CF_2)_2H$/ethanol (98.9/1.1)] /[N-methylpyrrolidone] = 80/20 |
| Example 30 | $[CF_3CFHCFHCF_2CF_3$/isopropanol (95.5/4.5)] /[N-methylpyrrolidone] = 70/30 |
| Example 31 | $[HCF_2CFHCF_2CFHCF_2H$/tert-butanol (95/5)] /[N-methylpyrrolidone] = 85/15 |
| Example 32 | $(CF_3)_2CFCH_2CF_2H$/methanol (93.3/6.7) |

TABLE 1C

| | Cleaning Solvent Composition |
|---|---|
| Example 33 | $[CF_3CF_2CH_2CF_2CF_3$/methanol (95/5)] /[N-methylpyrrolidone) = 95/5 |
| Example 34 | $[CF_3CF_2CH_2CF_2CF_3$/methanol (95/5)] /[N-methylpyrrolidone] = 50/50 |
| Example 35 | $[CF_3CF_2CH_2CF_2CF_3$/methanol (95/5)] [N-methylpyrrolidone] = 5/95 |
| Example 36 | $[CF_3CF_2CH_2CF_2CF_3$/methanol (95/5)] /[N-methylpyrrolidone] = 80/20 |
| Example 37 | $[CF_3CF_2CH_2CF_2CF_3$/methanol (95/5)]/[N-methylpyrrolidone/N, N-dimethylformamide (50/50)] = 80/20 |
| Example 38 | $[(CF_3)_2CFCH_2CF_2H$/methanol (93.3/6.7)] /[triethylamine] = 80/20 |
| Example 39 | $[(CF_3)_2CFCH_2CF_2H$/ethanol (95.4/4.6)] /[triethylamine] = 80/20 |
| Example 40 | $[(CF_3)_2CFCH_2CF_2H$/isopropanol (95.8/4.2)] /[triethylamine] = 80/20 |
| Example 41 | $[H(CF_2CF_2)_2H$/methanol (96.3/3.7)] /[N-methyl morpholine] = 80/20 |
| Example 42 | $[H(CF_2CF_2)_2H$/ethanol (98.9/1.1)] /[N-methyl morpholine] = 80/20 |
| Example 43 | $[(CF_3)_2CFCF_2CF_2H$/methanol (96.7/3.3)] /[N-ethyl morpholine] = 80/20 |
| Example 44 | $[(CF_3)_2CFCF_2CF_2H$/ethanol (97.9/2.1)] /[N-ethyl morpholine] = 80/20 |
| Example 45 | $[CF_3CF_2CH_2CF_2CF_3$/methanol (95/5)] /[tributyl amine] = 90/10 |
| Example 46 | $[CF_3CF_2CH_2CF_2CF_3$/ethanol (96.5/3.5)] /[tributyl amine] = 90/10 |
| Example 47 | $[CF_3CF_2CH_2CF_2CF_3$/isopropanol (97/3)] /[tributyl amine] = 90/10 |

TABLE 1D

| | Cleaning Solvent Composition |
|---|---|
| Example 48 | $[CF_3CFHCFHCF_2CF_3$/methanol (92.3/7.7)] /[N, N-dimethyl cyclohexylamine] = 70/30 |
| Example 49 | $[CF_3CFHCFHCF_2CF_3$/ethanol (94.5/5.5)) |

TABLE 1D-continued

| | Cleaning Solvent Composition |
|---|---|
| | /[N, N-dimethyl cyclohexylamine] = 70/30 |
| Example 50 | [$CF_3CFHCFHCF_2CF_3$/isopropanol (95.9/4.1)] /[N, N-dimethyl cyclohexylamine] = 70/30 |
| Example 51 | [$CF_3CF_2CF_2CH_2F$/methanol (95/5)]/[N, N, N', N'-tetramethyl hexane-1, 6-diamine] = 85/15 |
| Example 52 | [$HCF_2(CF_2)_3CH_2F$/ethanol (95/5)]/[N, N, N', N'-tetramethyl hexane-1, 6-diamine] = 85/15 |
| Example 53 | [$CF_3CF_2CF_2CFHCF_2H$/isopropanol (95/5)] /[triethylene diamine] = 85/15 |
| Example 54 | [$HCF_2CFHCF_2CFHCF_2H$/tert-butanol (95/5)] /[triethylene diamine] = 85/15 |
| Example 55 | [$(CF_3)_2CFCF_2CF_2H$/ethanol (95/5)) /[N, N'-dimethyl piperazine] = 85/15 |
| Example 56 | [$CF_3(CF_2)_3CH_2CH_3$/n-propanol (90/10)] /[N, N'-dimethyl piperazine] = 85/15 |
| Example 57 | [$(CF_3)_2CHCFHCF_2CF_3$/isopropanol (90/10)] /[1, 2-dimethylimidazole] = 80/20 |
| Example 58 | [$HCF_2(CF_2)_4CF_2H$/n-propanol (90/10)] /[1, 2-dimethylimidazole] = 80/20 |
| Example 59 | [$(CF_3)_2CFCFHCFHCF_3$/sec-butanol (90/10)] /[1, 2-dimethylimidazole] = 80/20 |
| Example 60 | $(CF_3)_2CFCH_2CF_2H$/tributyl amine (80/20) |
| Example 61 | $H(CF_2CF_2)_2H$/tributyl amine (80/20) |
| Example 62 | $(CF_3)_2CFCF_2CF_2H$/tributyl amine (80/20) |

TABLE 1E

| | Cleaning Solvent Composition |
|---|---|
| Example 63 | $CF_3CF_2CH_2CF_3$/tributyl amine (90/10) |
| Example 64 | $CF_3CFHCFHCF_2CF_3$/tributyl amine (70/30) |
| Example 65 | [$(CF_3)_2CFCH_2CF_2H$/methanol (93.3/6.7)] /[tributyl amine] = 80/20 |
| Example 66 | [$H(CF_2CF_2)_2H$/ethanol (98.9/1.1)] /[tributyl amine] = 80/20 |
| Example 67 | [$CF_3CFHCFHCF_2CF_3$/isopropanol (95.9/4.1)] /[N, N-dimethyl cyclohexylamine] = 70/30 |
| Example 68 | [$HCF_2CFHCF_2CFHCF_2H$/tert-butanol (95/5)] /[triethylene diamine] = 85/15 |
| Example 69 | $(CF_3)_2CFCH_2CF_2H$/methanol (93.3/6.7) |
| Example 70 | [$CF_3CF_2CH_2CF_2CF_3$/methanol (95/5)] /[triethylamine] = 95/5 |
| Example 71 | [$CF_3CF_2CH_2CF_2CF_{3/methanol\ (95/5)}$] /[triethylamine] = 50/50 |
| Example 72 | [$CF_3CF_2CH_2CF_2CF_3$/methanol (95/5)] /[triethylamine] = 5/95 |
| Example 73 | [$CF_3CF_2CH_2CF_2CF_3$/methanol (95/5)] /[triethylamine] = 80/20 |
| Example 74 | [$(CF_3)_2CFCH_2CF_2H$/methanol (93.3/6.7)] /[tetrahydro furfuryl alcohol] = 80/20 |
| Example 75 | [$(CF_3)_2CFCH_2CF_2H$/ethanol (95.4/4.6)] /[tetrahydro furfuryl alcohol] = 80/20 |
| Example 76 | [$(CF_3)_2CFCH_2CF_2H$/isopropanol (95.8./4.2)] /[tetrahydro furfuryl alcohol] = 80/20 |
| Example 77 | [$H(CF_2CF_2)_2H$/methanol (96.3/3.7)] /[ethylene glycol monobutyl ether] = 80/20 |
| Example 78 | [$H(CF_2CF_2)_2H$/ethanol (98.9/1.1)] /[ethylene glycol monobutyl ether] = 80/20 |

TABLE 1F

| | Cleaning Solvent Composition |
|---|---|
| Example 79 | [$(CF_3)_2CFCF_2CF_2H$/methanol (96.7/3.3)] /[2-dimethyl-amino ethanol] = 80/20 |
| Example 80 | [$(CF_3)_2CFCF_2CF_2H$/ethanol (97.9/2.1)] /[2-dimethyl-amino ethanol] = 80/20 |
| Example 81 | [$CF_3CF_2CH_2CF_2CF_3$/methanol (95/5)] /[ethylene glycol monoethyl ether] = 90/10 |
| Example 82 | [$CF_3CF_2CH_2CF_2CF_3$/ethanol (96.5/3.5)] /[ethylene glycol monoethyl ether] = 90/10 |
| Example 83 | [$CF_3CF_2CH_2CF_2CF_3$/isopropanol (97/3)] |

TABLE 1F-continued

| | Cleaning Solvent Composition |
|---|---|
| | /[ethylene glycol monoethyl ether] = 90/10 |
| Example 84 | [$CF_3CFHCFHCF_2CF_3$/methanol (92.3/7.7)] /[dipropylene glycol] = 70/30 |
| Example 85 | [$CF_3CFHCFHCF_2CF_3$/ethanol (94.5/5.5)] /[dipropylene glycol] = 70/30 |
| Example 86 | [$CF_3CFHCFHCF_2CF_3$/isopropanol (95.9/4.1)] /[dipropylene glycol] = 70/30 |
| Example 87 | [$CF_3CF_2CF_2CH_2F$/methanol (95/5)] /[ethylene glycol monophenyl ether] = 85/15 |
| Example 88 | [$HCF_2(CF_2)_3CH_2F$/ethanol (95/5) /[ethylene glycol monophenyl ether] = 85/15 |
| Example 89 | [$CF_3CF_2CF_2CFHCF_2H$/isopropanol (95/5)] /[ethylene glycol monoethyl hexyl ether] = 85/15 |
| Example 90 | [$HCF_2CFHCF_2CFHCF_2H$/tert-butanol (95/5)] /[ethylene glycol monoethyl hexyl ether] = 85/15 |
| Example 91 | [$(CF_3)_2CFCF_2CF_2H$/ethanol (95/5)] /[3-dimethylamino-1-propanol] = 85/15 |
| Example 92 | [$CF_3(CF_2)_3CH_2CH_3$/n-propanol (90/10)] /[3-dimethylamino-1-propanol] = 85/15 |
| Example 93 | [$(CF_3)_2CHCFHCF_2CF_3$/isopropanol (90/10)]/[2-(2-dimethylaminoethyl) methyl-amino ethanol] = 80/20 |

TABLE 1G

| | Cleaning Solvent Composition |
|---|---|
| Example 94 | [$HCF_2(CF_2)_4CF_2H$/n-propanol (90/10)]/[2-(2-dimethylaminoethyl) methyl-amino ethanol] = 80/20 |
| Example 95 | [$(CF_3)_2CFCFHCFHCF_3$/sec-butanol (90/10)]/[2-(2-dimethylaminoethyl) methyl-amino ethanol] = 80/20 |
| Example 96 | $(CF_3)_2CFCH_2CF_2H$/tetrahydro furfuryl alcohol (80/20) |
| Example 97 | $H(CF_2CF_2)_2H$/tetrahydro furfuryl alcohol (80/20) |
| Example 98 | $(CF_3)_2CFCF_2CF_2H$/tetrahydro furfuryl alcohol (80/20) |
| Example 99 | $CF_3CF_2CH_2CF_2CF_3$/tetrahydro furfuryl alcohol (90/10) |
| Example 100 | $CF_3CFHCFHCF_2CF_3$/tetrahydro furfuryl alcohol (70/30) |
| Example 101 | [$(CF_3)_2CFCH_2CF_2H$/methanol (93.3/6.7)] /[tetrahydro furfuryl alcohol] = 80/20 |
| Example 102 | [$H(CF_2CF_2)_2H$/ethanol (98.9/1.1)] /[tetrahydro furfuryl alcohol] = 80/20 |
| Example 103 | [$CF_3CFHCFHCF_2CF_3$/isopropanol (95.9/4.1)] /[tetrahydro furfuryl alcohol] = 70/30 |
| Example 104 | [$HCF_2CFHCF_2CFHCF_2H$/tert-butanol (95/5)] /[tetrahydro furfuryl alcohol]= 85/15 |
| Example 105 | $(CF_3)_2CFCH_2CF_2H$/methanol (93.3/6.7) |
| Example 106 | [$CF_3CF_2CH_2CF_2CF_3$/methanol (95/5)] /[tetrahydro furfuryl alcohol] = 95/5] |
| Example 107 | [$CF_3CF_2CH_2CF_2CF_3$/methanol (95/5)] /[tetrahydro furfuryl alcohol] = 50/50 |
| Example 108 | [$CF_3CF_2CH_2CF_2CF_3$/methanol (95/5)] /[tetrahydro furfuryl alcohol] = 5/95 |
| Example 109 | [$CF_3CF_2CH_2CF_2CF_3$/methanol (95/5)] /[tetrahydro furfuryl alcohol] = 80/20 |

TABLE 2A

| | Rinsing Agent Composition |
|---|---|
| Examples 1, 38, 74 | $(CF_3)_2CFCH_2CF_2H$/methanol azeotrope (93.3/6.7) |
| Examples 2, 39, 75 | $(CF_3)_2CFCH_2CF_2H$/ethanol azeotrope (95.4/4.6) |
| Examples 3, 40, 76 | $(CF_3)_2CFCH_2CF_2H$/isopropanol |

TABLE 2A-continued

| Rinsing Agent Composition | |
|---|---|
| | azeotrope (95.8/4.2) |
| Examples 4, 41, 77 | $H(CF_2CF_2)_2H$/methanol azeotrope (96.3/3.7) |
| Examples 5, 42, 78 | $H(CF_2CF_2)_2H$/ethanol azeotrope (98.9/1.1) |
| Examples 6, 43, 79 | $(CF_3)_2CFCF_2CF_2H$/methanol azeotrope (96.7/3.3) |
| Examples 7, 44, 80 | $(CF_3)_2CFCF_2CF_2H$/ethanol azeotrope (97.9/2.1) |
| Examples 8, 45, 81 | $CF_3CF_2CH_2CF_2CF_3$/methanol (95/5) |
| Examples 9, 46, 82 | $CF_3CF_2CH_2CF_2CF_3$/ethanol (96.5/3.5) |
| Examples 10, 47, 83 | $CF_3CF_2CH_2CF_2CF_3$/isopropanol (97/3) |
| Example 11 | $CF_3CFHCFHCF_2CF_3$/methanol (92.5/7.5) |
| Examples 12, 48, 85 | $CF_3CFHCFHCF_2CF_3$/ethanol azeotrope (94.5/5.5) |
| Example 13 | $CF_3CFHCFHCF_2CF_3$/isopropanol (95.5/4.5) |
| Examples 14, 51, 87 | $CF_3CF_2CF_2CH_2F$/methanol (95/5) |
| Examples 15, 52, 88 | $HCF_2(CF_2)_3CH_2F$/ethanol (95/5) |
| Examples 16, 53, 89 | $CF_3CF_2CF_2CFHCF_2H$/isopropanol (95/5) |
| Examples 17, 54, 90 | $HCF_2CFHCF_2CFHCF_2H$/tert-butanol (95/5) |
| Examples 18, 55, 91 | $(CF_3)_2CFCF_2CF_2H$/ethanol (95/5) |
| Examples 19, 56, 92 | $CF_3(CF_2)_3CH_2CH_3$/n-propanol (95/5) |
| Examples 20, 57, 93 | $(CF_3)_2CHCFHCF_2CF_3$/isopropanol (90/10) |
| Examples 21, 58, 94 | $HCF_2(CF_2)_4CF_2H$/n-propanol (90/10) |
| Examples 22, 59, 95 | $(CF_3)_2CFCFHCFHCF_3$/sec-butanol (90/10) |

TABLE 2B

| Rinsing Agent Composition | |
|---|---|
| Examples 23, 60, 96 | $(CF_3)_2CFCH_2CF_2H$/ethanol azeotrope (95.4/4.6) |
| Examples 24, 61, 97 | $H(CF_2CF_2)_2H$/methanol azeotrope (96.3/3.7) |
| Examples 25, 62, 98 | $(CF_3)_2CFCF_2CF_2H$/methanol azeotrope (96.7/3.3) |
| Examples 26, 63, 99 | $CF_3CF_2CH_2CF_2CF_3$/isopropanol azeotrope (97/3) |
| Examples 27, 64, 100 | $CF_3CFHCFHCF_2CF_3$/ethanol azeotrope (94.5/5.5) |
| Examples 28, 65, 101 | $(CF_3)_2CFCH_2CF_2H$ |
| Examples 29, 66, 102 | $H(CF_2CF_2)_2H$ |
| Examples 30, 67, 103 | $CF_3CFHCFHCF_2CF_3$ |
| Examples 31, 68, 104 | $HCF_2CFHCF_2CFHCF_2H$ |
| Examples 32, 69, 105 | $(CF_3)_2CFCH_2CF_2H$/methanol (93.3/6.7) |
| Examples 33, 70, 106 | $CF_3CF_2CH_2CF_2CF_3$/methanol azeotrope (95/5) |
| Examples 34, 71, 107 | $CF_3CF_2CH_2CF_2CF_3$/methanol azeotrope (95/5) |
| Examples 35, 72, 108 | $CF_3CF_2CH_2CF_2CF_3$/methanol azeotrope (95/5) |
| Examples 36, 73, 109 | $CF_3CF_2CH_2CF_2CF_3$/methanol azeotrope (95/5) |
| Example 37 | $CF_3CF_2CH_2CF_2CF_3$/methanol azeotrope (95/5) |
| Examples 48, 84 | $CF_3CFHCFHCF_2CF_3$/methanol azeotrope (92.3/7.7) |
| Examples 50, 86 | $CF_3CFHCFHCF_2CF_3$/isopropanol azeotrope (95.9/4.1) |

TABLE 3A

| Composition for Steam Cleaning | |
|---|---|
| Examples 1, 38, 74 | Same solvent as rinsing agent |
| Examples 2, 39, 75 | Same solvent as rinsing agent |
| Examples 3, 40, 76 | Same solvent as rinsing agent |
| Examples 4, 41, 77 | Same solvent as rinsing agent |
| Examples 5, 42, 78 | Same solvent as rinsing agent |
| Examples 6, 43, 79 | Same solvent as rinsing agent |
| Examples 7, 44, 80 | Same solvent as rinsing agent |
| Examples 8, 45, 81 | Same solvent as rinsing agent |
| Examples 9, 46, 82 | Same solvent as rinsing agent |
| Examples 10, 47, 83 | Same solvent as rinsing agent |
| Examples 11, 48, 84 | Same solvent as rinsing agent |
| Examples 12, 49, 85 | Same solvent as rinsing agent |
| Examples 13, 50, 86 | Same solvent as rinsing agent |
| Examples 14, 51, 87 | $CF_3CF_2CF_2CH_2F$/methanol (90/10) |
| Examples 15, 52, 88 | Same solvent as rinsing agent |
| Examples 16, 53, 89 | $CF_3CF_2CF_2CFHCF_2H$/isopropanol (85/15) |
| Examples 17, 54, 90 | $HCF_2CFHCF_2CFHCF_2H$/tert-butanol (85/15) |
| Examples 18, 55, 91 | $(CF_3)_2CFCF_2CF_2H$/ethanol (85/15) |
| Examples 19, 56, 92 | $CF_3(CF_2)_2CH_2CH_3$,n-propanol (80/20) |
| Examples 20, 57, 93 | $(CF_3)_2CHCFHCF_2CF_3$/isopropanol (80/20) |
| Examples 21, 58, 94 | $HCF_2(CF_2)_4CF_2H$/n-propanol (70/30) |
| Examples 22, 59, 95 | $(CF_3)_2CFCFHCFHCF_3$/sec-butanol (70/30) |

TABLE 3B

| Composition for Steam Cleaning | |
|---|---|
| Examples 23, 60, 96 | Same solvent as rinsing agent |
| Examples 24, 61, 97 | Same solvent as rinsing agent |
| Examples 25, 62, 98 | Same solvent as rinsing agent |
| Examples 26, 63, 99 | Same solvent as rinsing agent |
| Examples 27, 64, 100 | Same solvent as rinsing agent |
| Examples 28, 65, 101 | $(CF_3)_2CFCH_2CF_2H$ |
| Examples 29, 66, 102 | $H(CF_2CF_2)_2H$ |
| Examples 30, 67, 103 | $CF_3CFHCFHCF_2CF_3$ |
| Examples 31, 68, 104 | $HCF_2CFHCF_2CFHCF_2H$ |
| Examples 32, 69, 105 | Same solvent as rinsing agent |
| Examples 33, 70, 106 | Same solvent as rinsing agent |
| Examples 34, 71, 107 | Same solvent as rinsing agent |
| Examples 35, 72, 108 | Same solvent as rinsing agent |
| Examples 36, 73, 109 | (Steam cleaning is not conducted.) |
| Example 37 | Same solvent as rinsing agent |

TABLE 4A

Flux Removal Ability

| | Visual Inspection | Ionic Residue (μg NaCl/cm$^2$) | Degreasing Ability Degreasing Ratio |
|---|---|---|---|
| Example 1 | Surface cleaned (Satisfactorily cleaned) | <1 | A |
| Example 2 | Surface cleaned (Satisfactorily cleaned) | <1 | A |
| Example 3 | Surface cleaned (Satisfactorily cleaned) | <1 | A |
| Example 4 | Surface cleaned (Satisfactorily cleaned) | <1 | A |
| Example 5 | Surface cleaned (Satisfactorily cleaned) | 1.5 | B |
| Example 6 | Surface cleaned (Satisfactorily cleaned) | 1.2 | A |
| Example 7 | Surface cleaned (Satisfactorily cleaned) | 1.3 | B |
| Example 8 | Surface cleaned | 1.1 | A |

TABLE 4A-continued

| | Flux Removal Ability | | |
|---|---|---|---|
| | Visual Inspection | Ionic Residue (μg NaCl/cm$^2$) | Degreasing Ability Degreasing Ratio |
| | (Satisfactorily cleaned) | | |
| Example 9 | Surface cleaned (Satisfactorily cleaned) | 1.2 | A |
| Example 10 | Surface cleaned (Satisfactorily cleaned) | 1.2 | A |
| Example 11 | Surface cleaned (Satisfactorily cleaned) | 1.3 | A |
| Example 12 | Surface cleaned (Satisfactorily cleaned) | 1.5 | A |
| Example 13 | Surface cleaned (Satisfactorily cleaned) | 1.5 | A |
| Example 14 | Surface cleaned (Satisfactorily cleaned) | <1 | A |
| Example 15 | Surface cleaned (Satisfactorily cleaned) | <1 | A |
| Example 16 | Surface cleaned (Satisfactorily cleaned) | <1 | A |
| Example 17 | Surface cleaned (Satisfactorily cleaned) | <1 | A |
| Example 18 | Surface cleaned (Satisfactorily cleaned) | <1 | A |
| Example 19 | Surface cleaned (Satisfactorily cleaned) | <1 | A |
| Example 20 | Surface cleaned (Satisfactorily cleaned) | 1.2 | A |

TABLE 4B

| | Flux Removal Ability | | |
|---|---|---|---|
| | Visual Inspection | Ionic Residue (μg NaCl/cm$^2$) | Degreasing Ability Degreasing Ratio |
| Example 21 | Surface cleaned (Satisfactorily cleaned) | 1.2 | A |
| Example 22 | Surface cleaned (Satisfactorily cleaned) | 1.2 | A |
| Example 23 | Surface cleaned (Satisfactorily cleaned) | <1 | A |
| Example 24 | Surface cleaned (Satisfactorily cleaned) | <1 | A |
| Example 25 | Surface cleaned (Satisfactorily cleaned) | <1 | A |
| Example 26 | Surface cleaned (Satisfactorily cleaned) | 1.2 | B |
| Example 27 | Surface cleaned (Satisfactorily cleaned) | <1 | A |
| Example 28 | Flux deposition (Unsatisfactorily cleaned) | 3.5 | C |
| Example 29 | Flux deposition (Unsatisfactorily cleaned) | 3.8 | C |
| Example 30 | Flux deposition (Unsatisfactorily cleaned) | 3.1 | C |
| Example 31 | Flux deposition (Unsatisfactorily cleaned) | 3.6 | C |
| Example 32 | Unsatisfactory flux removal | 6.1 | C |
| Example 33 | Flux deposition (Insufficiently cleaned) | 3.5 | B |
| Example 34 | Surface cleaned (Satisfactorily cleaned) | <1 | A |
| Example 35 | Surface cleaned (Satisfactorily cleaned) | <1 | A |
| Example 36 | Surface cleaned (Satisfactorily cleaned) | 1.6 | B |
| Example 37 | Surface cleaned (Satisfactorily cleaned) | <1 | A |

TABLE 4B-continued

| | Flux Removal Ability | | |
|---|---|---|---|
| | Visual Inspection | Ionic Residue (μg NaCl/cm$^2$) | Degreasing Ability Degreasing Ratio |
| Example 38 | Surface cleaned (Satisfactorily cleaned) | <1 | A |
| Example 39 | Surface cleaned (Satisfactorily cleaned) | <1 | A |
| Example 40 | Surface cleaned (Satisfactorily cleaned) | <1 | A |

TABLE 4C

| | Flux Removal Ability | | |
|---|---|---|---|
| | Visual Inspection | Ionic Residue (μg NaCl/cm$^2$) | Degreasing Ability Degreasing Ratio |
| Example 41 | Surface cleaned (Satisfactorily cleaned) | <1 | A |
| Example 42 | Surface cleaned (Satisfactorily cleaned) | <1 | A |
| Example 43 | Surface cleaned (Satisfactorily cleaned) | <1 | A |
| Example 44 | Surface cleaned (Satisfactorily cleaned) | <1 | B |
| Example 45 | Surface cleaned (Satisfactorily cleaned) | <1 | A |
| Example 46 | Surface cleaned (Satisfactorily cleaned) | <1 | A |
| Example 47 | Surface cleaned (Satisfactorily cleaned) | <1 | A |
| Example 48 | Surface cleaned (Satisfactorily cleaned) | <1 | A |
| Example 49 | Surface cleaned (Satisfactorily cleaned) | <1 | A |
| Example 50 | Surface cleaned (Satisfactorily cleaned) | <1 | A |
| Example 51 | Surface cleaned (Satisfactorily cleaned) | 1.2 | B |
| Example 52 | Surface cleaned (Satisfactorily cleaned) | 1.2 | B |
| Example 53 | Surface cleaned (Satisfactorily cleaned) | <1 | A |
| Example 54 | Surface cleaned (Satisfactorily cleaned) | <1 | A |
| Example 55 | Surface cleaned (Satisfactorily cleaned) | <1 | A |
| Example 56 | Surface cleaned (Satisfactorily cleaned) | <1 | A |
| Example 57 | Surface cleaned (Satisfactorily cleaned) | 1.1 | B |
| Example 58 | Surface cleaned (Satisfactorily cleaned) | 1.1 | B |
| Example 59 | Surface cleaned (Satisfactorily cleaned) | 1.1 | B |
| Example 60 | Surface cleaned (Satisfactorily cleaned) | 1.1 | A |

TABLE 4D

Flux Removal Ability

| | Visual Inspection | Ionic Residue (μg NaCl/cm²) | Degreasing Ability Degreasing Ratio |
|---|---|---|---|
| Example 61 | Surface cleaned (Satisfactorily cleaned) | 1.1 | A |
| Example 62 | Surface cleaned (Satisfactorily cleaned) | 1.1 | A |
| Example 63 | Surface cleaned (Satisfactorily cleaned) | 1.2 | B |
| Example 64 | Surface cleaned (Satisfactorily cleaned) | <1 | A |
| Example 65 | Flux deposition (Unsatisfactorily cleaned) | 3.4 | C |
| Example 66 | Flux deposition (Unsatisfactorily cleaned) | 3.7 | C |
| Example 67 | Flux deposition (Unsatisfactorily cleaned) | 3.1 | C |
| Example 68 | Flux deposition (Unsatisfactorily cleaned) | 3.5 | C |
| Example 69 | Unsatisfactory flux removal | 6.1 | C |
| Example 70 | Flux deposition (Insufficiently cleaned) | 3.4 | B |
| Example 71 | Surface cleaned (Satisfactorily cleaned) | <1 | A |
| Example 72 | Surface cleaned (Satisfactorily cleaned) | <1 | A |
| Example 73 | Surface cleaned (Satisfactorily cleaned) | 1.6 | B |
| Example 74 | Surface cleaned (Satisfactorily cleaned) | <1 | A |
| Example 75 | Surface cleaned (Satisfactorily cleaned) | <1 | A |
| Example 76 | Surface cleaned (Satisfactorily cleaned) | <1 | A |
| Example 77 | Surface cleaned (Satisfactorily cleaned) | <1 | A |
| Example 78 | Surface cleaned (Satisfactorily cleaned) | 1.6 | B |
| Example 79 | Surface cleaned (Satisfactorily cleaned) | 1.3 | A |
| Example 80 | Surface cleaned (Satisfactorily cleaned) | 1.3 | B |

TABLE 4E

Flux Removal Ability

| | Visual Inspection | Ionic Residue (μg NaCl/cm²) | Degreasing Ability Degreasing Ratio |
|---|---|---|---|
| Example 81 | Surface cleaned (Satisfactorily cleaned) | 1.4 | A |
| Example 82 | Surface cleaned (Satisfactorily cleaned) | 1.5 | A |
| Example 83 | Surface cleaned (Satisfactorily cleaned) | 1.5 | B |
| Example 84 | Surface cleaned (Satisfactorily cleaned) | 1.5 | A |
| Example 85 | Surface cleaned (Satisfactorily cleaned) | 1.6 | A |
| Example 86 | Surface cleaned (Satisfactorily cleaned) | 1.5 | A |
| Example 87 | Surface cleaned (Satisfactorily cleaned) | 1.1 | A |
| Example 88 | Surface cleaned (Satisfactorily cleaned) | 1.1 | A |
| Example 89 | Surface cleaned (Satisfactorily cleaned) | 1.1 | A |
| Example 90 | Surface cleaned (Satisfactorily cleaned) | 1.1 | A |

TABLE 4E-continued

Flux Removal Ability

| | Visual Inspection | Ionic Residue (μg NaCl/cm²) | Degreasing Ability Degreasing Ratio |
|---|---|---|---|
| Example 91 | Surface cleaned (Satisfactorily cleaned) | 2.2 | A |
| Example 92 | Surface cleaned (Satisfactorily cleaned) | <1 | A |
| Example 93 | Surface cleaned (Satisfactorily cleaned) | <1 | A |
| Example 94 | Surface cleaned (Satisfactorily cleaned) | <1 | A |
| Example 95 | Surface cleaned (Satisfactorily cleaned) | <1 | A |
| Example 96 | Surface cleaned (Satisfactorily cleaned) | <1 | A |
| Example 97 | Surface cleaned (Satisfactorily cleaned) | <1 | A |
| Example 98 | Surface cleaned (Satisfactorily cleaned) | <1 | A |
| Example 99 | Surface cleaned (Satisfactorily cleaned) | 1.3 | B |
| Example 100 | Surface cleaned (Satisfactorily cleaned) | <1 | A |

TABLE 4F

Flux Removal Ability

| | Visual Inspection | Ionic Residue (μg NaCl/cm²) | Degreasing Ability Degreasing Ratio |
|---|---|---|---|
| Example 101 | Flux deposition (Unsatisfactorily cleaned) | 3.4 | C |
| Example 102 | Flux deposition (Unsatisfactorily cleaned) | 3.6 | C |
| Example 103 | Flux deposition (Unsatisfactorily cleaned) | 3.2 | C |
| Example 104 | Flux deposition (Unsatisfactorily cleaned) | 3.7 | C |
| Example 105 | Unsatisfactory flux removal | 6.1 | C |
| Example 106 | Flux deposition (Insufficiently cleaned) | 3.4 | B |
| Example 107 | Surface cleaned (Satisfactorily cleaned) | <1 | A |
| Example 108 | Surface cleaned (Satisfactorily cleaned) | <1 | A |
| Example 109 | Surface cleaned (Satisfactorily cleaned) | 1.6 | B |

The above-mentioned results clearly indicate the following:

(1) Examples 1 to 27, 38 to 64, and 74 to 100 are embodiments of the present invention. All of the objects subjected to cleaning, rinsing and vapor cleaning under the present invention produced satisfactory results in terms of flux removal ability and degreasing ability.

(2) Examples 28 to 32, 65 to 69, and 101 to 105 are not results obtained by using the present invention but are of comparative cases obtained by using rinsing agents which do not include alcohol (Examples 28 to 31, 65 to 68, and 101 to 104) or cleaning solvents which do not use as additions N-methylpyrrolidone, tertiary amines, nor alcohol having ether linkage or amino linkage (Examples 32, 69, and 105). None of the examples produced satisfactory effects. Examples 33, 70, and 106 are ones with a smaller content of N-methylpyrrolidone, triethylamine, or tetrahydro furfuryl alcohol. These examples had insufficient results.

(3) Examples 34 and 35, 71 and 72, and 107 and 108 represent embodiments of the present invention. They illustrate that more satisfactory results are obtained when the content of N-methylpyrrolidone, triethylamine, or tetrahydro furfuryl alcohol in the cleaning solvent is in the range of 10 to 95% by weight. Example 37 indicates that the combined use of N-methylpyrrolidone and dimethylformamide also produces satisfactory results.

(4) Examples 36, 73, and 109 produced results better than the comparative cases even without vapor cleaning after rinsing and therefore are included in the scope of the present invention.

(5) In regard to the said embodiments, rinsing agent compositions which are azeotropic compositions, produce invariable rinsing effects and, if recovered for reuse, they do not change in composition to retain the same properties.

We claim:

1. A cleaning process, comprising dipping an object to be cleaned into a cleaning solvent composition to remove dirty component wherein either aliphatic fluorohydrocarbon as expressed by the general formula $$C_nF_mH_{2n+2-m}$$

wherein, n and m are positive integral numbers, being $4 \leqq n \leqq 6$, $2n-3 \leqq m < 2n+2$, respectively, or a mixture of the said aliphatic fluorohydrocarbon and alcohol having a carbon number of 1 to 4 is blended with at least one member selected from the group consisting of lactam being alkyl pyrrolidone or pyrrolidone derivatives having a carbon number of 5 or 6 and/or carboxylic acid amide being formamides or acetamides having a carbon number of 1 to 4, tertiary amines having a carbon number of 5 to 12, and alcohol having ether linkage and/or amino linkage within its molecules being furfuryl alcohol, tetrahydrofurfuryl alcohol, or ethylene, diethylene, triethylene, or dipropylene glycol alkyl or monophenyl or monobenzyl derivatives having a carbon number of 3 to 10 or alkyl amino alkanols having a carbon number of 4 to 7, at a blending proportion of 10 to 95% by weight;

thereafter rinsing the object with a rinsing agent composition which comprises a mixture of said aliphatic fluorocarbon and said alcohol having a carbon number of 1 to 4, wherein the object, after being rinsed, is vapor cleaned with a composition comprising a mixture of said aliphatic fluorocarbon and the said alcohol having a carbon number of 1 to 4, the rinsing agent or vapor cleaning agent composition which is used for the above-mentioned rinsing and vapor cleaning processes is an azeotropic composition of $(CF_3)_2CFCH_2CF_2H$ (93.3%)/methanol (6.7%)/$(CF_3)_2CFCH_2CF_2H$ (95.4%)/ethanol (4.6%), $(CF_3)_2CFCH_2CF_2H$ (95.8%)/isopropanol (4.2%), $H(CF_2CF_2)_2H$ (96.3%)/methanol (3.7%), $H(CF_2CF_2)_2H$ (98.9%)/ethanol (1.1%), $(CF_3)_2CFCF_2CF_2H$ (96.7%)/methanol (3.3%), $(CF_3)_2CFCF_2CF_2H$ (97.9%)/ethanol (2.1%), $CF_3CF_2CH_2CF_2CF_3$ (95%)/methanol (5%), $CF_3CFHCFHCF_2CF_3$ (94.5%)/ethanol (5.5%), $CF_3CF_2CH_2CF_2CF_3$ (97%)/isopropanol (3%), $CF_3CFHCFHCF_2CF_3$ (92.3%)/methanol (7.7%), or $CF_3CFHCFHCF_2CF_3$ (95.9%)/isopropanol (4.1%).

* * * * *